United States Patent [19]

Bossart et al.

[11] Patent Number: 4,705,232

[45] Date of Patent: Nov. 10, 1987

[54] YARN TENSIONING DEVICE

[75] Inventors: Erwin Bossart, Flawil; Hans Hasler, Uzwil, both of Switzerland

[73] Assignee: Benninger AG, Uzwil, Switzerland

[21] Appl. No.: 19,174

[22] Filed: Feb. 26, 1987

[30] Foreign Application Priority Data

Mar. 5, 1986 [CH] Switzerland ..... 900/86

[51] Int. Cl.[4] ..... B65H 59/22

[52] U.S. Cl. ..... 242/150 R

[58] Field of Search ..... 242/150 R, 150 M, 149, 242/147 R, 131, 131.1, 129.8

[56] References Cited

U.S. PATENT DOCUMENTS

| | | | |
|---|---|---|---|
| 1,662,209 | 3/1928 | Remington | 242/150 R |
| 1,853,686 | 4/1932 | Kershaw | 242/150 R |
| 1,985,665 | 12/1934 | Munson | 242/150 R |
| 2,581,142 | 1/1952 | Rea | 242/150 R X |
| 2,758,802 | 8/1956 | Carlson | 242/150 R |
| 2,781,181 | 2/1957 | Ayars, Jr. | 242/150 R |
| 3,390,845 | 7/1968 | Brouwer et al. | 242/150 R |
| 3,473,757 | 10/1969 | Cashore | 242/150 R |

FOREIGN PATENT DOCUMENTS

| | | | |
|---|---|---|---|
| 814858 | 9/1951 | Fed. Rep. of Germany | 242/150 R |
| 293996 | 7/1928 | United Kingdom | 242/150 R |

*Primary Examiner*—Stanley N. Gilreath
*Attorney, Agent, or Firm*—William R. Hinds

[57] ABSTRACT

Yarn is clamped between two rotatably mounted brake plates. The lower brake plate lies on an annular housing portion and the upper brake plate is held and centered by a guide plate. Weighting discs lie on the guide plate and are secured by a pair of clamping projections. The guide plate is displaceable on a U-shaped loop member and is prevented from rotating thereon and is itself secured by pairs of clamping projections.

11 Claims, 4 Drawing Figures

YARN TENSIONING DEVICE

FIELD OF THE INVENTION

The invention relates to a yarn tensioning device for a bobbin creel, in particular for beaming or warping installations, wherein the yarn is passed through between upper and lower brake plates and the upper brake plate is loaded by means of weighting disks and wherein the upper brake plate and the weighting disks are guided at the center on a guide means.

The man skilled in the art is already familiar with the basic function and mode of operation of a yarn tensioning device. In the known devices of comparable general kind, the upper brake plate is loaded by means of weighting disks which can be stacked up until the desired yarn tension is attained. The brake plates are generally freely rotatably guided on a guide means which also serves to hold the weighting disks on the upper brake plate.

OUTLINE OF THE PRIOR ART

German patent specification No. 814858 discloses a yarn tensioning device in which the brake plates are of different diameters and are mounted eccentrically relative to each other. The different directions of movement of the brake plates, which are achieved as a result, are intended to produce an automatic cleaning effect. A felt ring is interposed between the upper brake plate and the weighting disks. The guide means used is a pin or bolt which is screwed to the cover of the housing.

Swiss patent specification No. 577571 discloses an adjustable yarn braking device which, besides a disk tensioner with upper disk which can be lifted off, also has a second disk tensioner with an upper disk which is constantly in a condition of operative contact. In both disk tensioners, the weighting disks are mounted rotatably on mounting pins which pass through the upper disks from below.

In the yarn tensioner disclosed in German patent specification No. 822819 the guide means for the two brake disks are three pins which are disposed at the corners of an equilateral triangle and which can serve at the same time as a yarn guide means.

A disadvantage of the known devices is that the maintenance and cleaning operations are relatively expensive. A relatively large amount of dust and dirt is produced at the yarn tensioner, in which respect particles may be deposited on the brake plates and may impair the functioning of the yarn brake, with the passage of time. In many known devices, such deposits are further increased by virtue of the fact that the particles cannot drop out freely. Cleaning of the device is frequently also made difficult because the entire device has to be dismantled and for example the weighting disks have to be individually stacked up again.

SUMMARY OF THE INVENTION

An object of the present invention is to provide a yarn tensioning device of the kind set forth in the opening part of this specification, which is substantially insensitive to contamination and fouling of any kind and which can be cleaned or maintained in a very simple manner without total dismantling. The invention further seeks to provide that the device comprises a small number of individual parts and can be used, without additional components, both on the left hand side and on the right hand side of a beaming or warping creel.

In accordance with the invention, that object is achieved with a yarn tensioning device in which the weighting disks are held by a guide plate which is displaceable on the guide means and in which the upper brake plate is centered with the guide plate lying thereon. As the weighting disks are held by a guide plate, they do not have to be individually removed in cleaning operations, but can be lifted off the upper brake plate directly on the guide plate. The upper brake plate is guided and centered by the guide plate so that the guide plate does not have to be rotatably mounted. That gives the advantage that the weighting disks do not also rotate with the upper brake plate.

If the weighting disks are held by a collar on the guide plate, which has at least one clamping nose or catch for securing the weighting disk in position, the weighting disk cannot be lost when the guide plate is lifted out. However the clamping nose permits weighting disks to be removed or added in a very simple manner.

In order to limit the relative displaceability of the guide plate on the guide means, the guide plate may have a catch or detent means for engagement into the guide means. The catch or detent means provides that the upper brake plate is always held in a centered position by the guide plate.

If the guide plate is provided with an apron which extends therearound and which overlaps the upper brake plate, that prevents dirt and dust from being deposited in the upper brake plate in a very simple manner.

The deposit of contaminating or fouling material may be further resisted by the guide means being a downwardly open, substantially U-shaped loop member which is passed through a slot in the guide plate. It will be apparent that the loop member, when arranged in that way, is more advantageous than the previously used bolts or pins, as dust and dirt can escape downwardly. Furthermore, the fact that the loop member is passed through a slot on the guide plate serves in a very simple manner to prevent rotational movement of the guide plate.

The yarn may be prevented from accidentally slipping out of the yarn tensioning device in a particularly simple manner if the U-shaped loop member is passed through a central opening on both brake plates, wherein the yarn is confined between the two limbs of the loop member.

If the lower brake plate lies on a substantially annular housing portion and is held and centered thereby, that ensures that particles of dust are discharged at the center in a downward direction. The U-shaped loop member may be releasably fixed at least with one limb to the annular housing portion so that the entire assembly consisting of the brake plates, the weighting disks and the guide means is ultimately carried by the annular housing portion. As a result of that configuration, the device is readily accessible from all sides so that for example it is also possible to observe functioning thereof, when it is in operation.

For the purposes of fixing the yarn tensioning device to the bobbin creel, the annular housing portion is arranged on a holding collar for fixing to a brake carrier bar, wherein the holding collar can be pressed together by means of a clamping screw. In that way, the yarn tensioning device can be steplessly displaced along the brake carrier bar, and locked in position thereon, by simply releasing the clamping screw.

The U-shaped loop member can be replaced and adjusted in a very simple manner if the annular housing portion comprises two parts which can be pressed together by means of the clamping screw, and if the U-shaped loop member can be fixed between the parts which can be pressed together.

To protect the braking arrangement, the brake plates are surrounded by a housing which is provided with two diametrically oppositely disposed guide openings for guiding the yarn. In that connection, it does not matter on which side of the bobbin creel the device is arranged as operation of the brake arrangement is basically independent of the direction of movement of the yarn.

DESCRIPTION OF THE DRAWINGS

In order that the invention may be clearly understood and readily carried into effect one device in accordance therewith will now be described, by way of example, with reference to the accompanying drawings, in which.

DESCRIPTION OF A PREFERRED EMBODIMENT

Figure 2:
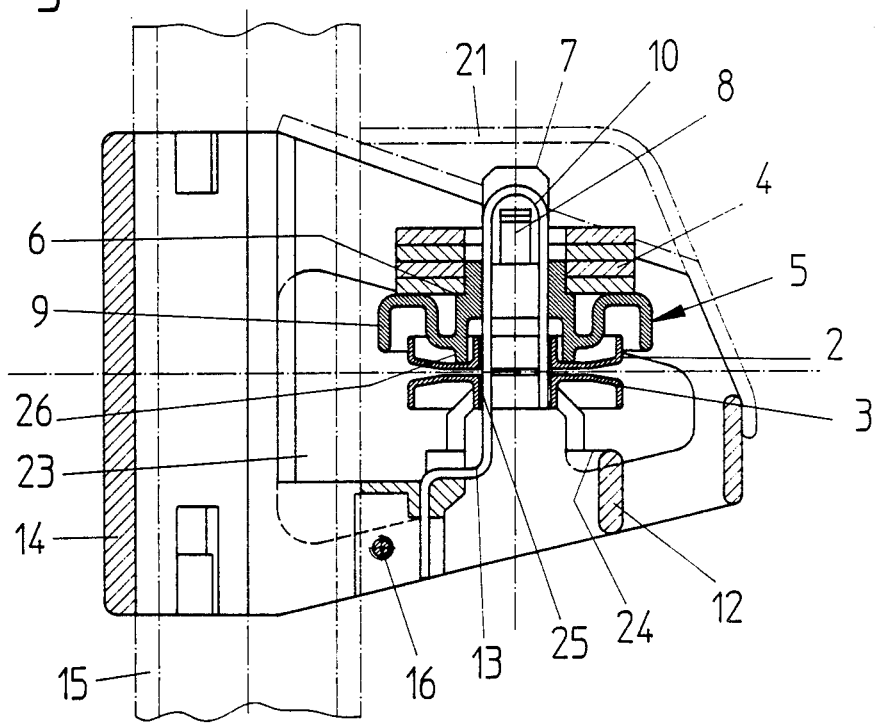
FIG. 2 is a view in section along line A—A in FIG. 1.
Figure 3:
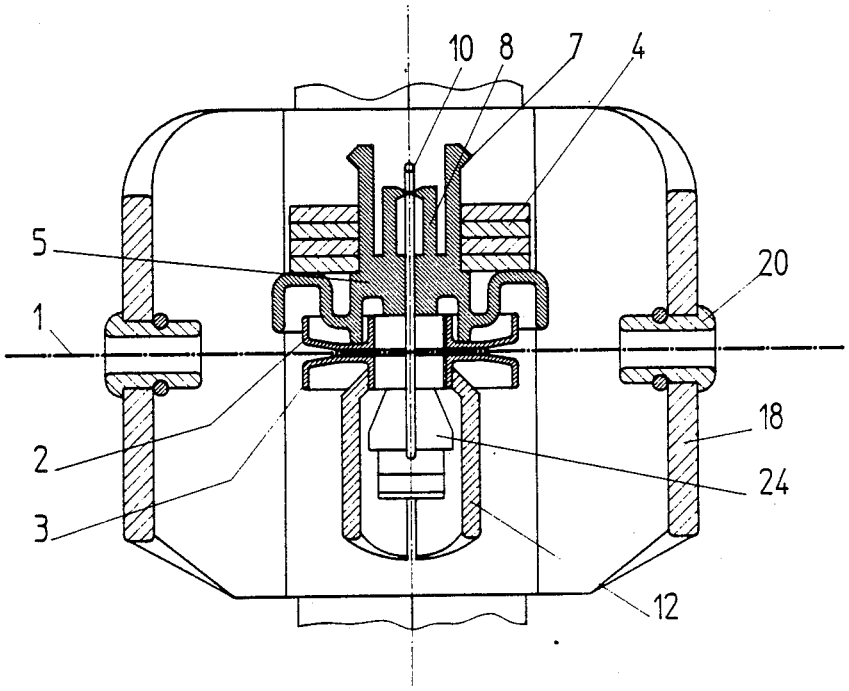
FIG. 3 is a view in section along line B—B in FIG. 1.

As can be seen in particular from FIGS. 2 and 3, the yarn 1 is guided between the upper brake plate 2 and the lower brake plate 3.

The two brake plates are of the same cross-sectional configuration and are bent away at their outer peripheral regions in order to make it easier to introduce the yarn and in order to avoid damaging the yarn. At their center the two brake plates have an opening and they are each provided with a hub 25. The hubs serve for centering and/or mounting the brake plates.

The lower brake plate 3 is supported rotatably on an annular housing portion 12 which tapers conically upwardly. In order to improve the removal of dirt and dust, the conical housing portion 12 is provided with openings 24 in its upper region.

Figure 1:
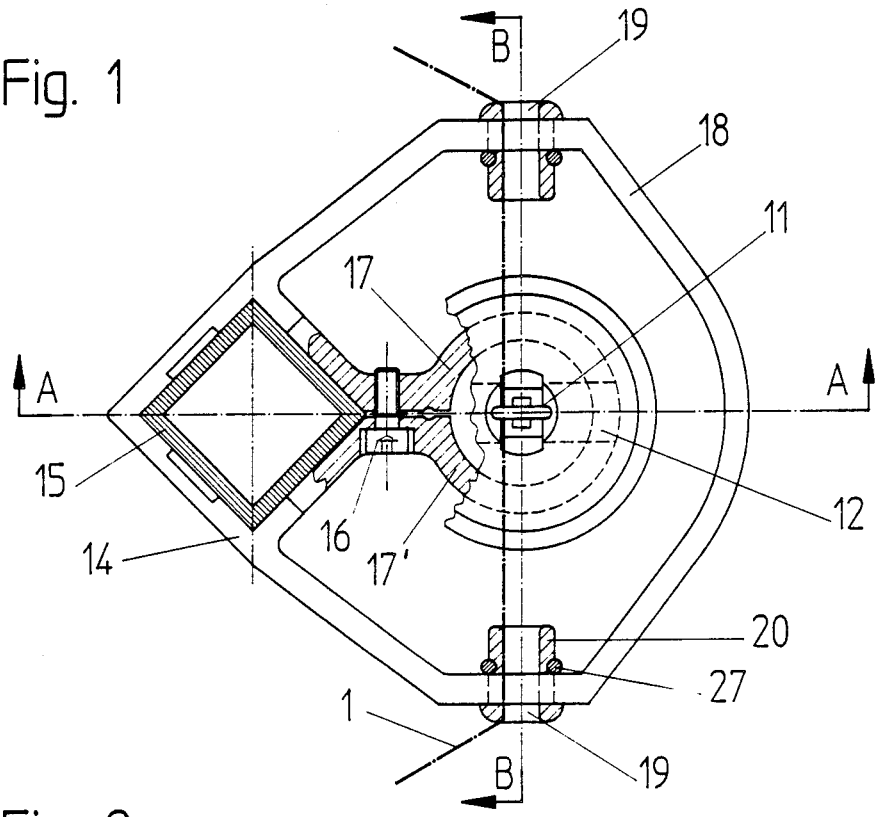
FIG. 1 is a plan view, partly in section, of a yarn tensioning device.

As shown in FIG. 1, the annular housing portion 12 is divided into two parts 17 and 17', each of which is connected to a portion of a holding collar 14. Both the holding collar 14 and the two parts 17 and 17' of the housing portion 12 can be pressed together by means of a clamping screw 16. The illustrated holding collar is of a square cross-sectional configuration but it couls also be of any other configuration. The holding collar 14 embraces a brake carrier bar 15 with the same cross-sectional configuration, being a component of a beaming or warping creel (not shown). The brake carrier bar 15 may accommodate a plurality of yarn tensioning devices in a vertical array. The devices in that arrangement are steplessly adjustable along the brake carrier bar 15 and can thus be adapted to any bobbin distribution. In addition the devices can be precisely oriented with respect to the bobbins.

A limb 13 of a U-shaped loop member 10 can also be fixed between the two parts 17 and 17' of the housing portion 12. The loop member 10 serves as a guide means for a guide plate 5 which lies on the upper brake plate 2. The U-shaped loop member is open downwardly and passes through the hubs 25 of the two brake plates, but without touching them. The guide plate 5 is provided with a braking ring 26 which lies on the upper brake plate 2 and which at the same time centers it at its hub 25. Provided at the outside peripheral region of the guide plate 5 is an apron 9 which overlaps or passes over the edge of the brake plate. Provided at the center of the guide plate 5 is a slot 11 through which the U-shaped loop member 10 is passed. In that way, the guide plate 5 can be displaced in a vertical direction along the U-shaped loop member 10 while being prevented from rotating.

Weighting disks 4 may be held and centered by a collar 6 on the guide plate 5. Arranged on the collar 6 is a pair of clamping noses or catches 7, which ensure that the weighting disks 4 cannot drop off when carrying out maintenance or assembly operations. The pair of clamping noses however are of a resilient nature in such a way that weighting disks can be removed or added, without using supplementary means.

In order to secure the guide plate 5 in position, a catch or detent means 8 is provided thereon. The catch means 8 also comprises a pair of clamping noses or catches, as can be seen from FIG. 3. When the guide plate 5 is fitted on to the upper brake plate 2, the catch means 8 snaps over the U-shaped loop member 10 so that the guide plate can be removed again only against the resistance of the clamping projections. It will be seen that the weighting disks 4, together with the guide plate 5, form a pack which can be removed and re-fitted in a particularly simple manner.

Fixed to the holding collar 14 is the outer housing 18 which surrounds and protects the actual braking device, at least in a horizontal plane. The housing 18 is provided with guide openings 19 for the yarn 1, into which are fitted eyes 20. As can be seen from FIG. 1, the openings 19 in the housing 18 are so arranged that the yarn 1 is enclosed between the limbs of the U-shaped loop member 10 and between the two brake plates 2 and 3. The eyes are fixed in position by means of securing rings 27 on the inward side of the housing.

The housing 18 is open downwardly so that dirt and dust particles can drop down unimpededly. In order to protect the superposed yarn tensioning devices on a brake carrier bar 15 from falling dirt, a housing cover 21 is fitted on the housing 18 by means of a snap closure arrangement. The cover 21 may be easily removed to provide access to the brake plates. Openings 23 are additionally arranged laterally in the housing 18, the openings 23 also serving for improved removal of dust. With that arrangement for example the yarn tensioning device may be ventilated or scavenged by means of a fan.

For the sake of enhanced clarity of the drawings, the brake plates 2 and 3 are not in contact with the yarn 1 in FIGS. 2 and 3. It will be appreciated however that the two brake plates practically touch each other in operation.

Figure 4:
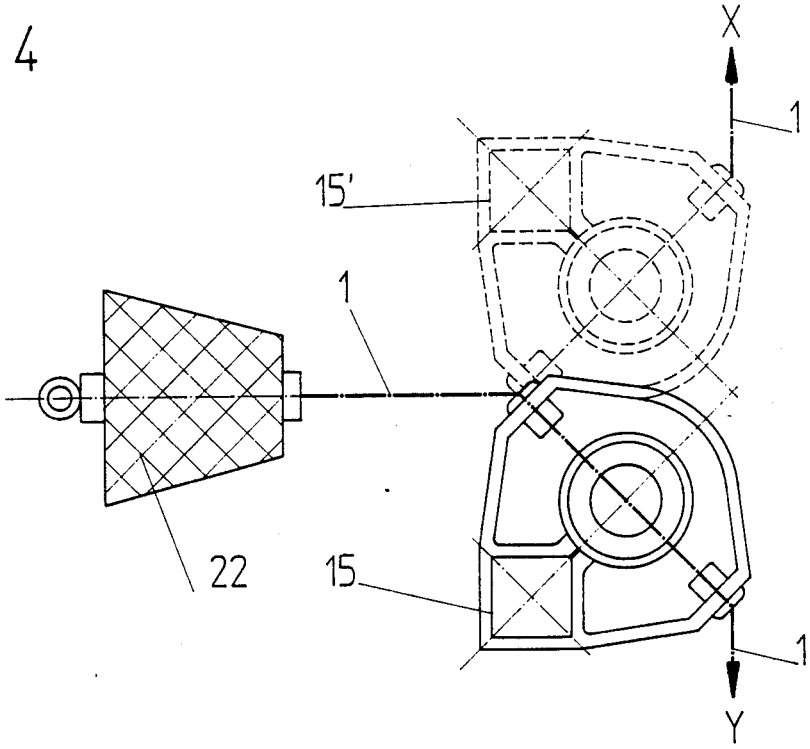
FIG. 4 is a diagrammatic view of a possible run of the yarn from a bobbin to the yarn tensioning device.

As can be seen from FIG. 4, the yarn 1 coming from a bobbin 22 may be deflected both in the direction indicated by the arrow X and also in the direction indicated by the arrow Y, with the same yarn tensioning device. As illustrated, to achieve that, it is only necessary for the yarn tensioning device to be moved from a brake carrier bar 15 on to a brake carrier bar 15' which is on the other side. That option of use of the tensioning device for both sides of a creel in an extremely rational aspect as no expensive conversion operations are required.

We claim:

1. A yarn tensioning device comprising a hollow housing, opposed separated yarn guides for guiding substantially horizontally yarn when passing through said housing, a lower brake plate support fixed in said housing for supporting a lower brake plate below and in contact with yarn when passed between said yarn guides, a lower brake plate mounted on said lower brake plate support, vertical guide means interposed between said yarn guides, an upper brake plate formed with an aperture for the passage therethrough of said guide means, said guide means and said upper brake plate being located for said upper brake plate to press yarn against said lower brake plate when yarn is passing between said yarn guides, a guide plate mounted for vertical reciprocation on said guide means and bearing on said upper brake plate, weighting disks stacked on said guide plate, and means for centering said weighting disks on said guide plate, whereby the weight of said disks determines the pressure of said upper and lower brake plates on the yarn when passing between said yarn guides.

2. A yarn tensioning device according to claim 1, in which said weighting disks are each formed with a central aperture, and said means for centering said weighting disks on said guide plate comprises a centering unit fixed with respect to said guide plate and extending upwards therefrom through said weighting disk apertures, said centering unit being formed with at least one releasable clamping nose for securing said weighting disks above said guide plate.

3. A yarn tensioning device according to claim 1, including catch means fixed to said guide plate, said guide means and said catch means being formed for interengagement to limit movement of said guide plate away from said upper brake plate beyond a predetermined amount.

4. A yarn tensioning device according to claim 1, in which said guide plate is provided with a peripheral downwardly extending apron that overlaps the periphery of said upper brake plate.

5. A yarn tensioning device according to claim 1, in which said guide means is a downwardly open, substantially U-shaped loop member and said guide plate is formed with a slot through which said loop member passes in a mating relationship therewith.

6. A yarn tensioning device according to claim 5, in which said U-shaped loop member is fixed to said housing in such relation with said yarn guides that yarn when passing through said yarn guides also passes through said loop member, said lower brake plate being formed with an aperture, and said loop member being mounted to pass through said apertures in said upper and lower brake plates.

7. A tensioning device according to claim 1, in which said housing is formed with a substantially annular portion forming said lower brake plate support for holding and locating said lower brake plate which lies thereon, said lower brake plate being formed with an aperture and said guide means being a downwardly open U-shaped loop member extending upwards from said substantially annular portion of said housing through said apertures in said lower and upper brake plates.

8. A yarn tensioning device according to claim 7, including means for releasably fixing at least one limb of said U-shaped loop member to said substantially annular portion of said housing.

9. A yarn tensioning device according to claim 7, in which said substantially annular portion of said housing is formed laterally with a holding collar for surrounding a brake carrier bar when the device is mounted for action, the device further including a clamping screw and said collar being formed with registering screw-threaded apertures on separate parts thereof located to receive said clamping screw and thereby enable said collar to the clamped to the brake carrier bar.

10. A yarn tensioning device according to claim 7, in which said annular portion is formed with two juxtaposed parts formed respectively with registering screw-threaded apertures, at least one limb of said U-shaped loop member being formed for interposition between said parts, the device further including a clamping screw for screwing into said screw-threaded apertures to clamp said limb between said parts.

11. A yarn tensioning device according to claim 1, in which said yarn guides are guide eyes replaceably fitted to said housing.

* * * * *